United States Patent [19]

Mayo et al.

[11] 4,010,704

[45] Mar. 8, 1977

[54] BUOYANT SPHERE

[75] Inventors: Kenneth E. Mayo; Charles R. Fink, both of Nashua, N.H.

[73] Assignee: Energy Systems Corporation, Nashua, N.H.

[22] Filed: Aug. 10, 1973

[21] Appl. No.: 387,335

[52] U.S. Cl. ..... 114/267; 114/125; 251/212

[51] Int. Cl.[2] ..... B63B 39/00

[58] Field of Search ..... 9/8 R, 8 P; 114/.5 D, 114/.5 T, 43.5, 121, 125; 251/212; 61/1 R

[56] References Cited

UNITED STATES PATENTS

| | | | |
|---|---|---|---|
| 1,339,321 | 5/1920 | Crouch | 9/8 R |
| 1,998,886 | 4/1935 | Scheid | 251/212 X |
| 2,742,055 | 4/1956 | Seewer | 251/212 X |
| 3,349,740 | 10/1967 | Field | 114/125 X |
| 3,391,666 | 7/1968 | Schuller, Jr. | 114/.5 D |
| 3,553,968 | 1/1971 | Armistead | 61/1 R X |

FOREIGN PATENTS OR APPLICATIONS

| | | | |
|---|---|---|---|
| 900,773 | 10/1944 | France | 114/125 |
| 12,441 | 5/1910 | United Kingdom | 114/125 |

OTHER PUBLICATIONS

John F. Holmes et al., "Tuned Drilling Platform," Jan. 1970, Ocean Industry, pp. 71, 73–75, 77.

*Primary Examiner*—Robert J. Spar
*Assistant Examiner*—Donald W. Underwood

[57] ABSTRACT

A buoyant body with a spherical hull having a well extending along a vertical axis. The well is open at both ends to permit flow of water therein and is such dimension as to make the period of its vertical oscillation greater than the period of vertical oscillation of any waves of significant height reasonably expected to be encountered by the body. The body is otherwise weighted so as to be tuned against roll oscillation.

11 Claims, 9 Drawing Figures

BUOYANT SPHERE

BACKGROUND OF THE INVENTION

The present invention relates to floating bodies and in particular to spherical floating bodies employed as oceanic and deep water loading terminals, drill rigs and movable as well as stationary bulk cargo vessels.

It has recently been advanced in U.S. Pat. No. 3,487,484 granted Jan. 6, 1970 to J. F. Holmes, entitled "Tuned Floating Bodies" that if a sphere be made of suitable size, with its weight distributed in such a way that its natural period of oscillation about a horizontal diameter is much longer than the period of any waves that it is likely to encounter, that the body would in fact follow the vertical and translateral movement of the waves but exhibit little or no roll. It has been suggested to use such spheres as floating bodies to house floating power plants, offshore drill rigs, light houses and similar vessels which are intended to be substantially stationary in position or at best moveable at slow speeds over limited distances.

One problem not overcome by the aforementioned patent is the effect of ocean wave "Heave" on the sphere. That is the rhythmic movement of the sphere in a vertical up and down motion caused by the actual rising and falling of the succeeding waves. In offshore drilling rigs this vertical motion must be maintained within relatively narrow limits if successful and economic drilling operations are to be performed. It has been normal practice to compensate for "Heave" in this instance by increasing the weight of the vessel, hence, the structure necessary to support this weight. This cascading of events is avoided by the instant invention. In other applications of the sphere, for instance in housing of floating reactor power plants, heave accelerations must be limited to avoid acceleration loading and consequent subsequent wear of bearings in rotating machinery.

In a paper entitle "Drillship Designed for Heavy Seas" in the February 1972 Ocean Industry, target Roll and Heave standards were set which establish that for 80% of the necessary drill operations a roll of as much as 14° and a 5 to 7 foot double amplitude heave can be sustained. For certain other operations the maximum roll and heave cannot exceed 2.2° and 2.7 feet.

It is the general object of the present invention to provide a spherical body tuned to avoid roll which is simultaneously provided with means by which heave is eliminated under virtually all sea states and deep water conditions.

It is an object of this invention to provide a tuned sphere, having an integral structural configuration which effectively and fully limits heave.

It is another object of the invention to provide a floating sphere, tuned simultaneously against roll and heave, thus providing a stable, floating vessel capable of being employed as support for drill rigs, power plants, or other oceanic structures, as well as bulk cargo vessels.

It is a specific object of the present invention to provide a tuned sphere with means for fully limiting heave to predetermined values which means is adjustable so as to be controllable with respect to specific sea conditions.

It is of course, an object of this invention to provide a tuned sphere having means for eliminating heave which is simple and relatively light in weight.

Other objects and advantages of the present invention will be seen from the following disclosure.

SUMMARY OF THE INVENTION

Briefly, according to the present invention a floating body is provided having a hull in the general shape of a spherical segment with at least one base. The hull is tuned so that its natural period of oscillation about a horizontal diameter is greater than the period of any wave of significant height reasonably expected to be encountered by the body. The hull is provided with a well or hollow bore, extending along a central diameter open at its top and bottom which is dimensioned so that the resultant natural period of hull vertical oscillation is attenuated and made to be greater than the vertical period of any of the waves reasonably to be encountered, without the inordinate concern for the distribution and magnitude of weight with respect to the heave axis that has heretofore been practiced, and wherein a more controlled damping effect is also obtained.

According to the present invention, the provision of the well serves to reduce the planar area of the hull intercepted along the water line (water plane intercept) as well as providing a viscous damping constant within the body itself. The benefit of the present invention lies in the face that a more stable floating body is obtained in which the natural period of heave is made long with respect to the period of the waves without a much greater latitude in the distribution of weight or its magnitude with respect to the heave direction than has heretofore been possible is attained and wherein a more controlled damping effect is also obtained.

Full details of the present invention follow herein and are depicted in the accompanying drawings.

DESCRIPTION OF THE INVENTION

Figure 1:
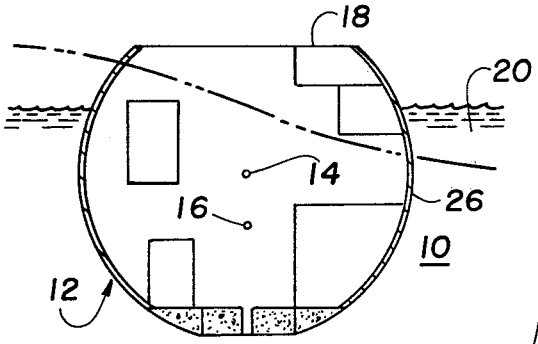
FIG. 1 is a schematic diagram of a buoyant spherical body.
Figure 2:
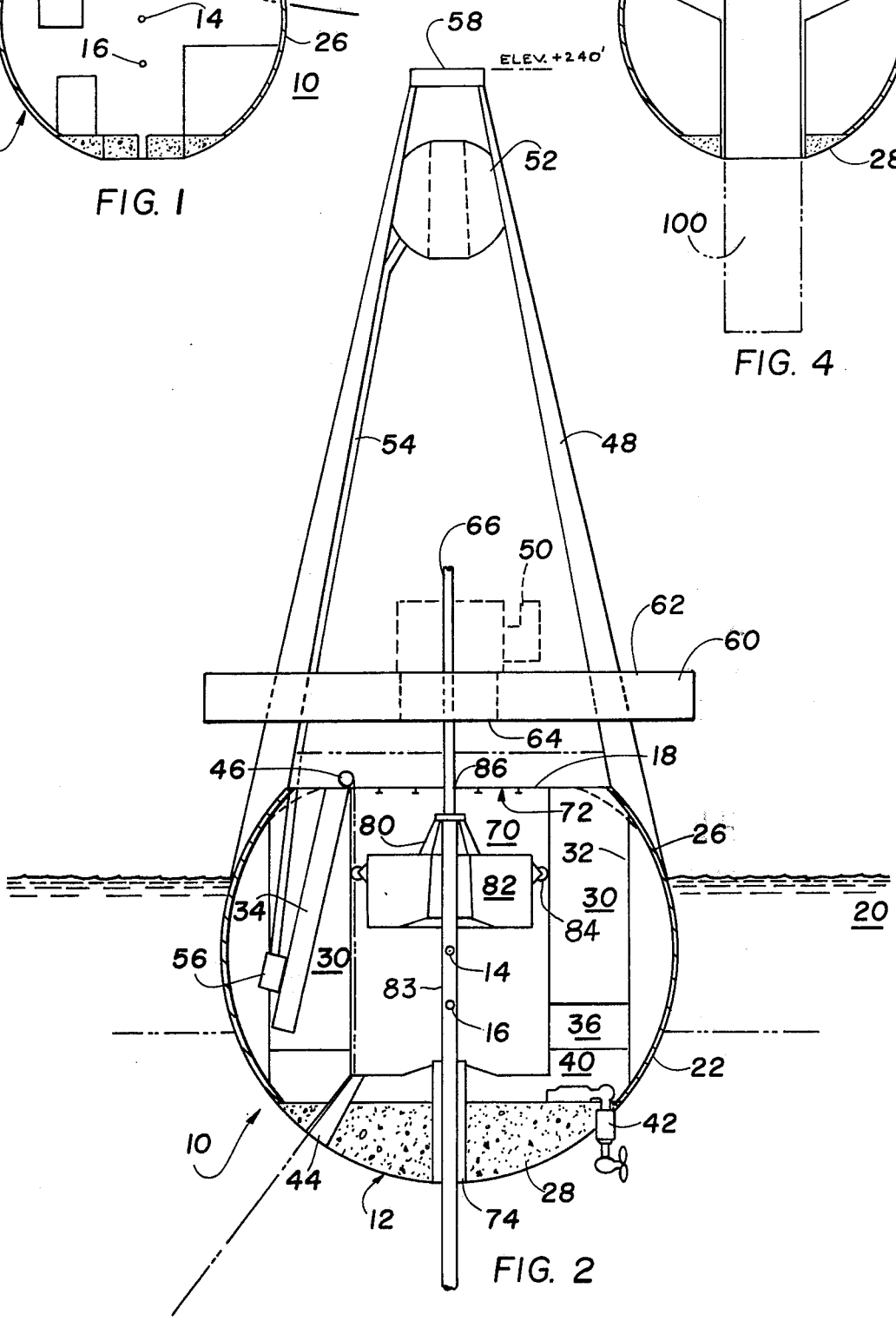
FIG. 2 is a schematic cross sectional view of a body incorporating the central compensating well of the present invention.

The present invention, as illustrated in FIG. 2, is applied to a buoyant vessel, generally depicted in FIG. 1 by the numeral 10, which is basically a tuned sphere constructed in accordance with the provisions of Holmes, U.S. Pat. No. 3,487,484. The vessel comprises a body 12 having the exterior shape of a major spherical segment, having a geometric center 14, a center of gravity 16, and a flat planar base 18. The body of the sphere is of such size that it will float substantially submerged in a body of water depicted by the numeral 20. In general, if the weight were concentrated at the geometric center 14, the body would be balanced and it would roll freely in random direction as a result of the wave forces, however, because its center of gravity 16 is offset below the geometric center, the sphere is unbalanced and oscillates as a pendulum about the geometric center 14, at what is referred to as the natural period of oscillation. The offset center of gravity 16 more importantly provides the body with the correct righting moment which enables the sphere to be maintained upright with the base 18 generally horizontal.

The period of oscillation is generally given by the expression $$Tr = 2\pi \sqrt{I/K_1} \qquad \text{Eq. (1)}$$

where

Tr = period of roll about the center;
I = moment of inertia about the center of rotation;
$K_1$ = roll stiffness, or Wh, where
W = total weight; and
h = vertical distance from center of rotation (center of sphere) to center of gravity.

By tuning the sphere (that is by properly distributing structural and other masses within and on the sphere) so that the natural period of roll, as determined by the above equation, is greater than the period of any waves of significance reasonably expected to be encountered by the submerged body, then the actual roll of the sphere may be virtually eliminated. As a result, the sphere is maintained substantially upright (i.e., centers 14 and 16 lie along a vertically disposed diametric axis) and the base 18 is maintained substantially horizontal and perpendicular to it. A small degree of roll does exist since the system is fluid, however, the degree of roll is negligible in calmer sea states and only very minor in the more heavy sea states.

The foregoing equation is well known and can be found in one form or another in many handbooks including Marks' "Mechanical Engineers' Handbook" sixth edition, (McGraw-Hill 1964) at page 3–30 wherein the time necessary for a single swing, not back and forth, is given. A similar equation can be found in "Machinery's Handbook", seventeenth edition (The Industrial Press 1964) at page 348 as equation (2). The equations in these handbooks will be found to be equivalent to Eq. (1) above when due consideration is given to the notation of the authors.

The body 12 includes a hull 22, which may be made of steel, wood, prestressed concrete or other suitable materials and their combinations. For example, it may be desired to make the lower 2/3 of the sphere of a shell 24 of prestressed concrete, to reduce the concern about maintenance and the upper portion 26 of steel for supportive strength. In any event, the choice of materials can be left to the designer. The body is fixedly ballasted, preferably with concrete, as indicated by the numeral 28, in part providing the righting moment necessary to maintain the base horizontal.

FIG. 2, in addition to illustrating the present invention, illustrates the use of the sphere as a drill rig. The interior of the body is generally divided into a plurality of cylindrical or annular spaces 30 concentric about the vertical diametric axis passing through centers 14 and 16 to more easily maintain weight balance thereabout. The annular spaces are, however, further subdivided into small compartments by employing suitable bulkheads 32, etc. The subdivisions may take any shape or configuration provided that the weight balance about the diametric axis is maintained. These compartments may be used for drill pipe storage 34, fuel and drilling mud retention 36, temporary water ballast 38 and living as well as work operating rooms 40 necessary for the maintenance and functioning of a sea going oil drilling rig.

Suitable passages, doors, stairwells, etc. are provided to provide means for exchanging ballast, cargo, personnel, etc.

Above the fixed ballast and in suitable compartments or tunnels there are mounted a plurality of drive engines or thrusters 42, preferably comprising an internal combustion engine, electric motor or the like, having a propeller which is directionally movable so that the sphere can be propelled in the water in any direction. The fixed ballast may be provided with one or more anchor ports 44 through which an anchor may be dropped and lifted. The anchor line extends upwardly through the sphere to a winch 46 mounted on the base. Note that anchoring forces are vectored substantially through the center of rotation 14 to eliminate anchoring forces as potential roll inducers.

Mounted on the sphere to extend upwardly above the base 18 in conventional manner is a braced multi-pod frame 48 which supports the drill rig assembly, generally depicted by the numeral 50. A hollow ball 52 is located at or near the apex of the frame 48, which is connected by an elongated standpipe 54 to a pump 56 located in the sphere, which is adapted to pump water to the ball 52. The ball comprises the "tuning" ballast which can be variably filled to provide an additonal weight by which the roll tuning is obtained. Above the ball 52 a crown block platform 58 is provided which serves as the highest hoisting point for the derrick.

Mounted above and spaced from the base 18 and parallel to it is a housing 60 of one or more decks, the upper surface of which comprises a drill deck 62. Suitable living and operating facilities are located within the housing. Preferably, the housing is circular although it may be square or irregular in shape if desired. The housing is further provided with a central hole 64 through which the drill string 66 will pass.

Even though tuned, as described above in connection with the Holmes patent, the simple sphere shown does heave, that is it oscillates up and down with the movement of the waves, since the passing crests and troughs of the wave cause the normal water line to rise, as seen in FIG. 1. This varies the displacement of the sphere and hence the buoyant force of the water on the body, so that the spherical body tends to follow directly the movement of the water surface.

The period of vertical oscillation is generally obtained by the expression $$T_h = 2\pi \sqrt{\frac{W}{gK_2}} \qquad (2)$$

where $T_h$ = period of heave;
W = total weight or displacement of sphere
g = gravitational constant; and
$K_2$ = change in buoyancy per foot of change in water line The change in buoyancy per foot of change in water line, can be expressed merely in terms of water density and the area of the sphere intercepted at the water line, referred to hereafter as the "intercept plane" at the mean water level (mwl). Consequently the expression (Eq 2) can be rewritten as $$T_h = 2\pi \sqrt{\frac{W}{\rho A_{wp} g}} \quad (3)$$

where $A_{wp}$ equal the area of the sphere intercepted by the plane of the water line and $\rho \approx 64$ lbs/ft$^3$.

This equation is equivalent to the equation for the period of free vibration of a weight suspended by a spring. The equation is given for example, in the sixth edition of "Marks' Mechanical Engineers' Handbook", (McGraw-Hill 1964) on page 5–97 (with reference to his FIG. 1 on page 5–96) as his equation (4), namely:

$$T = 2\pi \sqrt{\frac{W}{kg}} \quad (2a)$$

where

T = Period of free vibration (without damping)
W = Weight of body
g = gravitational constant
K = spring constant.

A body floating in a liquid medium is, in its most basic form, a simple spring-mass system, analogous to the spring-mass system discussed by Marks. The resonant heave period of such a floating body is described by the foregoing equation (2*a*). In the present application, is the displacement of the spherical body and its appurtenances and contents in pounds. K, the spring constant, is the incremental change in the buoyant force of the water acting on the spherical hull when the hull is vertically displaced relative to the water line from its rest position (or when the water line is vertically displaced relative to the hull). The buoyant force necessary to produce unit movement of the body in the vertical, or heave, direction is measured by the change in pounds of water displaced by the body in a unit movement; thus K of equation (2*a*) becomes $$K = \frac{\text{water volume change} \times \text{water density}}{\text{unit movement}}$$

If we let

*d* = water density in pounds per sq. ft.;
*h* = unit movement in feet
Awp = the water plane intercept area of the spherical hull at rest, in sq. ft.; and
l = a unit water thickness, in feet, then
V = water volume change = Awp × l, and $$K = \frac{Awp \times 1 \times d}{h}$$

From this we see, since l = h = unity, that the equation for heave be written as $$T_h = 2\pi \sqrt{\frac{W}{Awp \times d \times g}} \quad (2b)$$

This is equivalent to equation (2) with $K_2 = Awp \times d$.

Submersibles, such as elongated submarines, have consequently sought to reduce the transverse cross-sectional area of the vessel at the water line and find smoothest riding just below the surface of the sea. This however, is not possible with a sphere and particularly with spheres which are adapted to provide platforms or containers for operations exterior thereof. Spheres under consideration here may be only semi-submersible since they may have a significant portion above the mean water line to support exterior superstructure and must have significant size and buoyancy so that considerable payload weight can be carried by it.

In accordance with the present invention, heave is reduced substantially more than the currently acceptable standards in sea states of great peril, for example such as conditions 5 and 6 and are greatly reduced in the sea states 7 and 8 having waves of 40 – 100 feet (double amplitude) with wave periods in excess of 17 seconds. This is accomplished basically as seen in FIG. 2, by the provision of a heave compensating well 70 extending concentrically to the diametric axis open at its upper end 72 through the base 18 and provided with an orifice conduit 74 opening at the bottom end of the sphere to render the well in communication to the flow of water. The well 70 provides a stable pool of substantially level and calm water within the sphere which rises and falls but slightly from the mean water level, although the waves rise and fall more dramatically. The well 70 provides for a simple modification of the water intercept plane resulting in a highly responsive attenuation of the natural heave period of the sphere and a damping of the response to variations in wave position (height) on the sphere surface. Attenuation of the natural heave occurs because the compensating well minimizes the water plane intercept relative to the buoyancy of the sphere, and without changing its external configuration or its degree of submergence.

An example of this is clearly established from a comparison of the conventional sphere shown in FIG. 1 and the inventive embodiment of FIG. 2. Assume that each sphere has a diameter of 150 feet and is outfitted as a drill platform, each carrying the same equipment and pay load, therefore being of equal displacement. Assume the FIG. 1 sphere to be submerged to its major diameter, draft = 75 feet, to buoy the vessel weight:

Draft = Diameter/2 = radius $R_1$ = 75 ft.
Area of water plane intercept = $\pi R_1^2 = A_1$ = 17700 ft.$^2$
Displacement = weight = ½ Spherical volume ($\rho$)= $\rho/2\ 4/3\ \pi R_1^3 = W_1 = 56.7 \times 10^6$ lbs The calculated heave period of the FIG. 1 sphere is found by:

$$T_{h_1} = 2\pi \sqrt{\frac{W_1}{A_1 \rho g}} = 2\pi \sqrt{\frac{56.7 \times 10^6}{17{,}700 \times 64 \times 32.2}} = 7.8 \text{ secs} \quad (4)$$

Taking now the case of the construction of the sphere in FIG. 2 in accordance with the present invention, that is, with the well 70 of 40 feet diameter. The heave period may be calculated in the same way as for FIG. 1 except that the expression (Eq 4) must be modified to account the increased submergence necessary to balance the buoyancy loss resulting from introduction of the well. Since displacement of the FIG. 2 sphere equals that of the FIG. 1 sphere, in Eq 4 only the water plane intercept area is changed by inclusion of the well.

The draft of the FIG. 2 sphere at equal displacement to the FIG. 1 sphere is 99 feet.

Height of spherical segment above new water intercept plane = Diameter − Draft = h = 51 ft.

Volume of spherical segment = $\frac{1}{3}\pi(h^2)(3R-h) = V_1 = 475000$ ft.$^3$ Radius of sphere at water intercept plane = $R_2$ $$\sqrt{\frac{6V_1 - \pi h^3}{3\pi h}} = \sqrt{\frac{2{,}432{,}000}{482}} = 71.8 \text{ ft.}$$

Cross-sectional area of sphere at water intercept plane = $A_2 = \pi R_2^2 = 16200$ Cross-sectional are of well = $\pi 20^2 = A_3 = 1260$ Water plane area = $A_2 - A_3 = A_4 = 14940$ ft.$^2$ The calculated heave period of the FIG. 2 sphere is found to be:

$$T_{h_2} = 2\pi\sqrt{\frac{W_1}{A_4 \rho g}} = 2\pi\sqrt{\frac{56.7 \times 10^6}{14940 \times 64 \times 32.2}} = 8.5 \text{ secs}$$

It is thus clearly seen that by providing the heave compensation well, the natural period of heave of the sphere has been enlarged to 8.5 seconds from the 7.8 seconds of the FIG. 1 sphere, that sphere without the heave compensating well.

The damping well 70 serves another function, in that the riser pipe 83 may be supported by a support 80 and float 82 provided with skids or rollers 84 about its periphery. The riser float 82 will normally rest on the relatively stable pool of water in the well 70 and maintain the riser pipe at a relatively constant tension. Thus regardless of the sea condition and the actual heave of the sphere the riser remains fixed. The upper edge or deck 18 is covered by a metal grate 86 or other open cover.

The level of the water and its pressure on the water within the well or pool is established by the pressure of the water at the well inlet orifice or bottom opening. Since there is a pressure integrating effect as depth increases, the pressure at the inlet to the pool will be more uniform than will be the wind and wave swept surface of the water around the sphere. Thus, the surface of the water in the pool, even without any damping restriction or lower orifice, will reflect a much more even and uniform level than the surrounding sea as a function of the depth of the vessel and thus the opening to the pool. As a result, the buoyancy of water within the pool is more constant, reacting not only on any structive float on its surface, but equally on the internal walls of the sphere, that is the walls of the pool. Thus the sphere is stabilized from within, along its central axis. The shape of the water pool walls actually controls the spring constant, or ability of the sphere to lift or buoy the weight of the sphere. This spring constant is of course variable, that is it is changed by the flow of water into the pool as the height of the pool varies and causes a greater or less displaced volume. This variation is controlled, that is, regulated by the shape of the walls of the pool and thus the water plane intercept area at any level.

Figure 3:
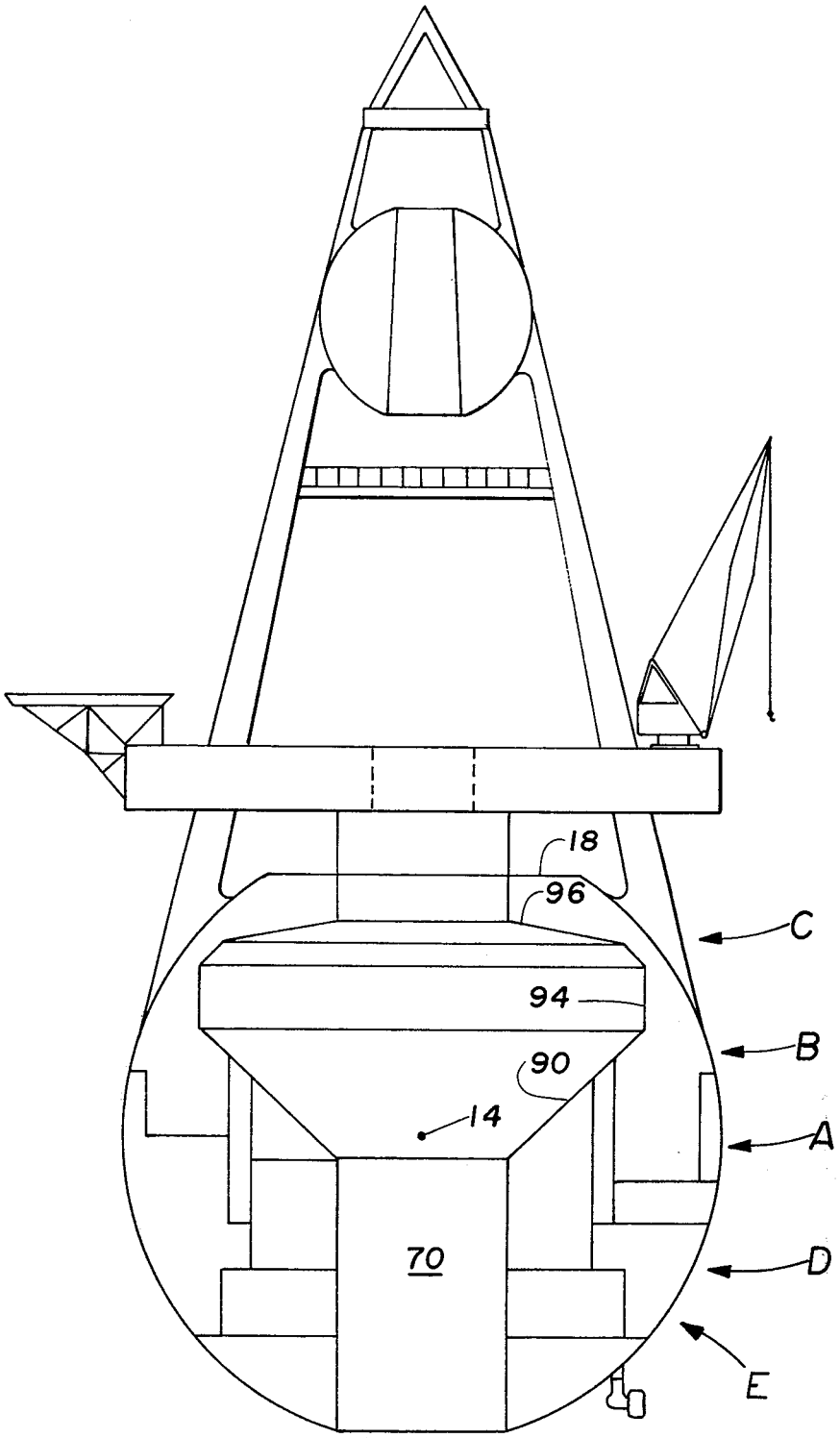
FIG. 3 is a view similar to FIG. 2 showing another well configuration in another embodiment of the present invention.

Now, consider the case where the well 70 is configured as in FIG. 3. This example will illustrate further that by preselecting the size and shape of the well relative to the sphere, a natural period of heave may be obtained which is further increased to a value greater than the oscillatory period of waves reasonably to be encountered under any given sea state condition.

Assume the FIG. 3 sphere to be of equal displacement to the FIG. 1 and 2 spheres, i.e., carrying the same structural weight equipment, pay load and ballast. Further assume the FIG. 3 well volume at 99 feet draft to be equal to that of the FIG. 2 well at 99 feet draft. However, the FIG. 3 well is configured as in FIG. 3 such that the well radius at the water plane intercept provides a water plane intercept and $A_5 = 2000$ ft.$^2$ The calculated heave period of the FIG. 3 embodiment of the instant invention then is:

$$T_{h_3} = 2\pi\sqrt{\frac{W_1}{A_5 \rho g}} = 2\pi\sqrt{\frac{56.7 \times 10^6}{2000 \times 64 \times 32.2}} = 23.2 \text{ secs.}$$

The undesirably low natural heave periods of the FIG. 1 and 2 configured spheres has been increased by the properly configured compensating well by a factor of 3 with the result that the very desirable natural heave period of 23.2 seconds is achieved.

With the well configured as in FIG. 3 rising and falling waves continually intercept a changing water plane intercept are with the result that the natural heave resonance period of the vessel is ever changing. This means that a vessel incorporation a compensating well so configured cannot be driven into resonant motion because a natural resonant period does not exit in the dynamic situation, i.e., it exists only in theory and in the static situation where it is of only theoretical interest.

At this point it becomes clear that the preferred design for low heave does not have a constant period $T_h$ nor a simple analytical $T_h$ result, although, however, the $T_h$ range of the FIG. 3 well can be determined by static analysis of water plane intercepts at various well depths, i.e., drafts.

The following gives specificity to the well of FIG. 3 beyond that conveyed by the FIG. 3 illustration. The drill rig of FIG. 2 is modified so as to provide a heave compensating well which provides a changing "water plane intercept area" automatically variable with the depth of submergence of the sphere and with the changing mean water level. As seen in FIG. 3, the well 70 is radially enlarged at its upper end 90 in funnel like configuration. The preferred embodiment shows that the funnel enlargement comprises an outwardly tapering wall section 90 extending from below the level of geometric center to a point approximately 2/3 the height of the sphere, from which point it extends upwardly in a cylindrical wall section 94 to a point just below the deck 18, wherein the cover section 96 returns to the original cylindrical well wall diameter. The tapering wall of the funnel is set at an angle between 30° – 45° of the horizontal. Operatively, the sphere is weighted by the conventional cement ballast and the water level in ball 52, so that its maximum cruising water level, depicted by the arrow A is slightly above the point at which the taper begins (generally about the level of the geometric center) wile its minimum cruising water lever is indicated by the arrow D. This allows for the creation of variable cruise heaving period, dependent of the condition of the sea without structural modification of the sphere or well. Drilling depth levels are defined by the enlarged cylindrical section indicated between arrow B and arrow C. Between these levels a constant pool of calm water is maintained in the sphere well and the well maintains a "water plane intercept" variable with respect to the incurve of the sphere, i.e., where slight incurve of the sphere exists (closest to the equator) a larger taper is provided, while at the markedly incurved hull section the well section is relatively cylindrical and uniform. The empty water level without stores aboard, nor fuel nor ballast water, is indicated by the arrow E. At this point the vessel or sphere may be most easily towed or brought into shallow harbors.

It has been demonstrated earlier that a tuned spherical drill vessel can be effectively tuned in heave by providing a large shaped pool or well along its vertical axis. The most apparent reason for effectiveness of this technique is that the well of the tuned sphere has an integrating effect over the buoyancy of the entire vessel. This effect is pronounced within the embodiment seen in FIG. 3, where the tapering well provides an automatically variable function with respect to the buoyancy. In the same manner as that shown earlier, an increase of wave amplitude or the submergence of the sphere by additional ballasting attenuates the period of heave response. A further advantage of the construction of FIG. 3, is that the further the sphere is submerged, the larger the weight of constant calm water within the vessel becomes. This creates an additional stabilizing force on the sphere.

Two effects can be immediately seen in reviewing the structures of FIG. 2 and FIG. 3.

The sphere provides load carrying capability equal to or greater than that of conventional semi-submersible drill platforms, all while regaining smaller overall span distances between extreme outermost water intercept hull points, typically 150 ft. in the sphere vs nominally 300 ft. in the semi-submersible. This means the sphere has lesser moment arms for torque generation, hence, roll producing buoyancy differences. Further, structural stresses are likewise reduced.

The large heave damping or resonance controlling well or pool in the sphere has a continuous level surface since its level reflects the water pressure at the bottom opening rather than the larger wave profile. Thus, it provides a greater displaced volume on the wave trough side than is applied by the wave profile and a similar converse effect on the wave crest side of the sphere.

The combination or product of these effects yields a greatly reduced wave induced roll torque on the sphere relative to any prior vessel, even relative to the so-called "semi-submersibles" currently being built by oil drilling companies for deep ocean mobile drilling use.

This benefit of the shaped water pool cannot be achieved in the prior art even by flooding or shaping the buoyancy columns of semi-submersibles. The semi-submersible has its water plane area distributed among several separate buoyant columns, three to eight typically.

The distributed water plane area of these columns is always effected by the local wave profile at the column whereas contrarywise the buoyancy of the sphere is always integrated by the internal water pool which reflects the water pressure at the inlet opening. Thus the buoyancy or restoring spring constant of the sphere can be varied widely over much smaller draft changes than can the buoyancy or spring constant of the semi-submersible. For example, at drill depth, the sphere of FIG. 3 would be ballasted for minimum water plane area, minimum heave and minimum spring constant. However, within 5 feet of vertical movement, the spring constant dramatically increases, so that heavy loads can be lifted without substantial depth change (avoiding, for instance, over travel of riser tensioning or heave compensation systems). If a similar reduction of spring constant were attempted on conventional semi-submersibles, the full excursion of the significant wave would have to be provided for or a reduced buoyancy-rate over a height of 30 to 40 feet. The effectiveness of a lesser length of shaping would be minimal because of the lack of the wave surface integrating effect in the semi-submersible. It must be concluded that the water plane area of conventional vessels, even semi-submersibles, has been designed to be the smallest area that is tolerable commensurate with the load lifting-depth change limits in conjunction with ballast pumping capabilities. Thus, it can be concluded that their water plane area cannot be substantially reduced over significant vertical distances without encountering important operational problems, and from the above, it can be seen that reducing the water plane area for short vertical distances on conventional vessels, as is done in the FIG. 3 sphere will be quite ineffective as a means of heave control. On the other hand, the present invention accomplishes all of this with a minimum of apparatus, or complex control.

The response of the systems near resonance, that is the damping effect of the water, and the acceleration of the water in the passages of the heave compensating well, depends not only on the size of the intercept plane but also on the size of the inlet orifice permitting flow of water. Accordingly, it is essential that the well be open both at its bottom, or inlet, and at the top so that neither air or water are trapped within the well, and a free flow of fluid is established. The opening at both top and bottom permits the pressure head of the water in the pool to be established solely by the pressure of the sea at the level of the inlet opening.

Figure 4:
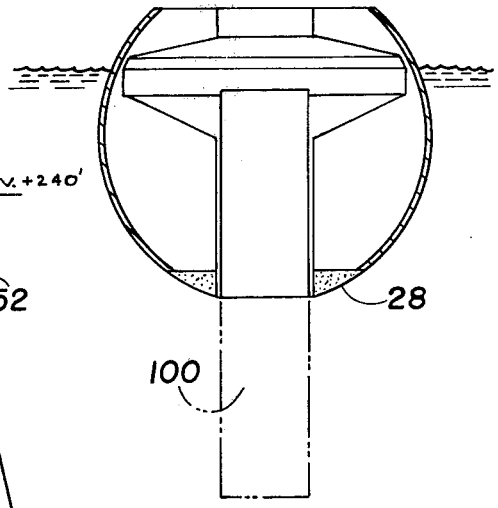
FIG. 4 is a view showing a modification of the FIG. 3 embodiment of the present invention.

In certain instances it may therefore be desirable to change or vary the level of the inlet opening without otherwise modifying the structure or the other parameters of the system. Means for establishing such a modification is shown in FIG. 4. Here a telescoping tube or hollow cylinder 100 is mounted within the well and is provided with means by which it may automatically be extended from or retracted into the well. Such means may be an electric or hydraulic motor, with a transmission linkage etc., of a common and conventional nature. Extension of the tube 100, lowers the effective inlet opening, placing it at a greater level beneath the mean water level than would the bottom of the sphere. At this greater depth the sea water has an increased pressure, but more importantly, its pressure is more constant and less effected by surface waves, thereby communicating to the well the effect of an apparently calmer sea. Selective extension, selectively varies the amount of ocean depth integration effect usable for aiding in heave stabilization, commensurate with the depth of the ocean in the operating area, and heave period response.

It is well known that the pressure effects of waves diminish as the depth below the waves increases. It has been established that this characteristic is logrithmic with an asympototic approach to zero at great depths. On the other hand at only 40 – 50 feet depth the effect of surface waves is typically reduced by $1/3$ that on the surface while at 100 feet the pressure variations are much smaller. Thus the tube 100 need only extend about 100 feet to be effective in producing an inlet pressure in the well, free of any substantial effect or variance caused by the surface waves, notwithstanding their size. This is to say that if the present inventive tube were used with the well of FIG. 2, the water level variation in the well would be less than 8 feet with the passing of a 40 foot wave. If this invention were not used, the water level could be expected to vary as much as 13 feet and possibly more. This is a simplified description of a dynamic process and the dynamic effects of phase, natural frequencies, coupling forces which all have an impact on the actual instantaneous water level in the well. However, the unexpected effect of the invention characteristics is that they conspire to collectively add stability to the sphere so that the simple extension of the telescoping extension tube brings a number of complimentary effects into play.

First, as has been discussed previously, it is desirable to increase the natural period of oceanic spheres since there is little wave energy in the lower frequency — longer period wave spectra. Since the resonance of a tube of water is proportional to the mass of water, extending the tube decreases the resonant frequency or extends the period toward lower wave energy content ranges.

Second, extending the well as described, couples a larger mass of water at a distance further from the center of rotation of the sphere, and thus, materially increases roll inertia.

Third, since water is essentially incompressible, the instant of occurrence of a wave at the sphere is simultaneous with the instant of corresponding pressure at the bottom of the well. Thus, assuming a relatively open or undamped stabilizing well, the phase shifts that would be associated with damping techniques used by others to stabilize vessels are not expected here. Thus, as the wave surface outside rises, the surface of the well will be relatively synchronous and not produce complex peaks of "beat" energy as is sometimes found in multi-resonant systems. At any rate, the length of the extension, which is instantly variable, will enable full operational control of such characteristics. This is not to say damping is undesirable, but in this design its characteristics are dynamically controlable to a greater than usual degree.

Fourth, if the "fixed ballast" 28 of FIG. 4 were attached to the extendable telescoping tube, the extension of the tube would not only increase roll inertia dramatically, but would also increase the metacentric height of the vessel and provide a much greater "list stiffness."

Fifth, the creation of a more stable "water pool" level under dynamic sea conditions further increases the uses to which the pool can be put. For example, if in a rough sea, the pool level is to only move 6 or 8 feet, a surface floating "riser support system" for oil drilling appears more practical than ever before, protected from the drag forces of ocean current by the well and its extension. Also, the large calm water surface will enable diving operations to take place from within the pool in sea conditions that would not previously permit water entry with ease and safety. This, thereby increases the utility of the platform for ocean salvage, underwater oil well completions and for underwater shelter tender operations.

Since the forces associated with damping are always proportional to velocity and since control of damping is important for the control of motion response at input frequencies near the resonant frequency, it is desirable to obtain functional control of the amount of damping force available and thus the resultant effects of phase and amplitude. Unlike previous vessels, such as semi-submersibles and ship shape vessels, the instant invention provides substantially complete control of the damping function of the motion equations. FIGS. 5, 6, 7, 8 and 9 show various views of controllable damping orifices adapted to the heave compensating well of this invention. As has been earlier stated, it is often desirable, as when the forcing function is not near the resonant frequency of the vessel, to minimize damping force. However, when the forcing function or wave action is near the resonant frequency of the vessel, motion response is substantially reduced by adding damping forces. This is done in a fixed way on semi-submersibles by providing flat top surfaces on the pontoons and thus causing water turbulence when vertical motions occur. In the case of tuned sphere with heave compensating wells as shown herein, however, substantially greater damping forces can be generated by partially closing the lower opening of the well. This can be done in a predesigned and fixed way as shown in passage 74 of FIG. 2; or it can be provided in an adjustable opening as is shown by the rotatable slot arrangement of FIGS. 5 and 6. However, the most completely controllable arrangement is the opposed blade damper arrangement of FIGS. 7, 8 and 9 which can be controlled by lever arms from within the vessel, and thus, be adjusted to suit experience of operation and weather conditions to optimize vessel motion control at any time.

Figure 5:
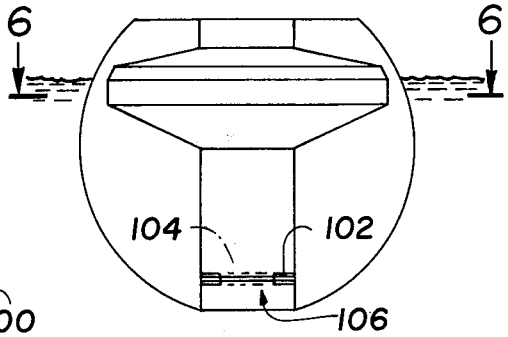
FIG. 5 is a view of the sphere of the present invention having damping control means for controlling the flow of water.
Figure 6:
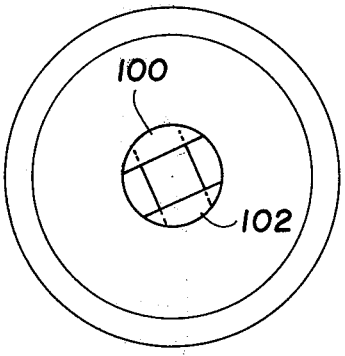
FIG. 6 is a sectional view of FIG. 5 taken along lines 6—6.

In the embodiment shown in FIGS. 5 and 6 a fixed minimum damping and a fixed maximum damping is established, and the system provides variable damping between these limits, in a spherical vessel 10 having a heave compensating well 70 floating at water line 20. The device comprises a pair of fixed damping plates 102 and a pair of movable damping plates 104. The damping plates are segments of a circle having a diameter equal to the diameter of the well. The chordal base of the segments however, are less than the diameter. The two fixed plates 102 are secured to the walls of the well so that their chordal bases are parallel and oppose to each other to form an open central slot 106 of rectangular shape extending across the well in a plane perpendicular to the axis of the well. The open slot 106 defines the minimum damping position. The movable damping plates 104 are mounted below the fixed plates 102 so that in open position they lie congruently with them, leaving the slot 106 open. The movable plates 104 are mounted to be arcuate swung parallel to the wall of the well 70 about the central axis of the well. For example, the arcuate edge may be provided with a gear rack engaging with a pinion rotatable by a suitable electric motor. Hydraulic, or other means may be employed. When the damping plates 104 are adjusted, they are rotated about the axis of the well to the position shown in FIG. 6 so that the previous slot opening 106 is reduced to a square opening. This represents the maximum flow restriction and thus maximum damping.

An advantage of this design is that it is simple and thus inexpensive to manufacture and reliable in design and operation. A disadvantage may, in some cases be seen in the limitations of maximum and minimum damping range.

A more complex, but more versatile variable damper may take the form of an iris or aperture opening similar to those used to control the aperture of optical lenses. In this embodiment, it would be preferable to recess the assembly into the walls of the well so that in the open position, the aperture provides a clear open cylindric passageway or virtually no damping. The design of the iris can then provide for virtually complete closure of the orifice in which case, the mass of the water in the well is virtually added to the mass of the vessel for dynamic response analysis. This embodiment provides total range of damping control, but as provided in a large vessel of say 30,000 tons displacement, the forces involved are large and thus this mechanism could be massive and expensive, although effective. While it represents an excellent technical solution to full range damping control, then, this embodiment may in many instances provide more control range than needed and thus, unnecessary expense.

Figure 9:
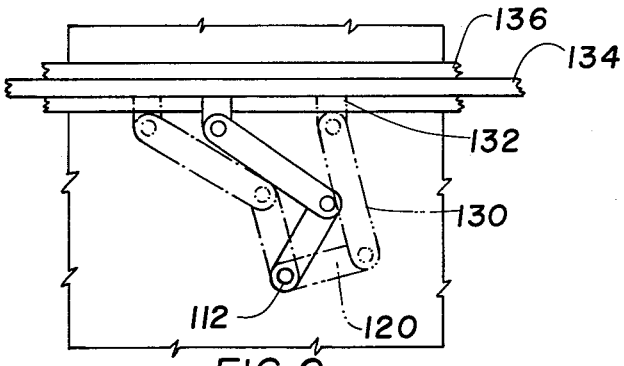
FIG. 9 is a sectional view of the damping control means of FIG. 8.
Figure 8:
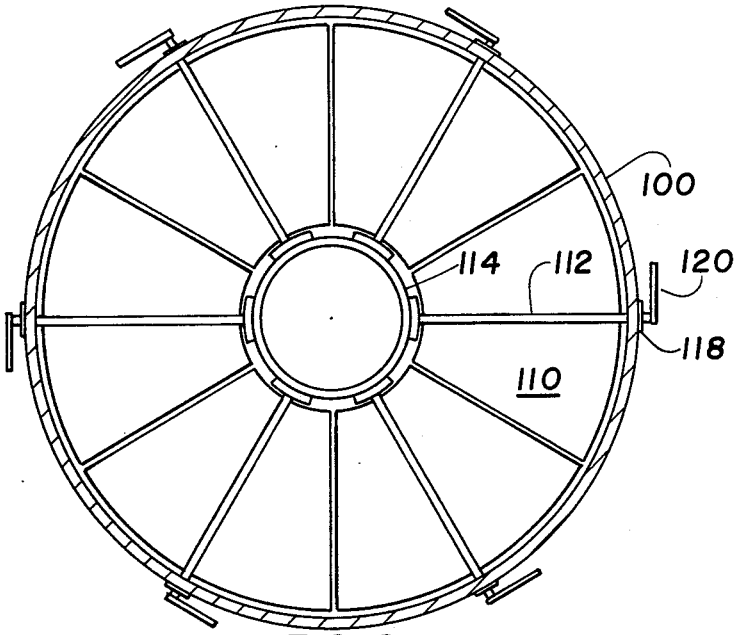
FIG. 8 is a view of still another damping control means.
Figure 7:
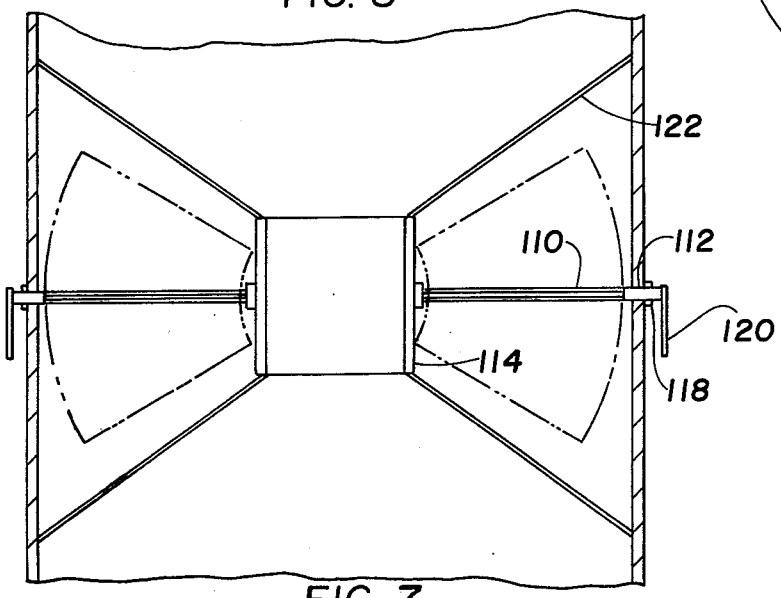
FIG. 7 is a vertical section showing details of another damping control means.

Another embodiment that can be economical and functionally practical over a wide range of control is a leaf or butterfly damper as shown in FIGS. 7 to 9. In this embodiment, a plurality of vanes or leaves 110 are arranged on radially mounted shafts 112 which extend from a central hub 114 through the wall 116 of the heave compensating well 70. Each such penetration of the wall is provided with a packing box 118 to prevent leakage into the hull of the sphere. Each such shaft is provided with a crank arm 120 the outer ends of which are interconnected through a linkage that causes the vanes to move conjointly in unison so that the vanes move from a position parallel to the axis of the well to a position transverse to the well, essentially shutting off flow through the well. The center hub 114 can be either solid or it can be hollow as shown with an internal diameter sufficient to allow drilling or lifting equipment to pass through the hub. Guy braces 122 are arranged about the hub so they are clear of the vanes in all positions and so they will balance the large axial forces that are developed from damping. If the guy braces are made as tension members, they can be small in cross section and not contribute a significant increase in flow resistance in and of themselves. FIG. 7 shows these braces as pin jointed rods.

FIG. 9 shows a partial section of the heave compensating well looking axially along a typical vane axis from the crank end. FIG. 9 shows a typical mechanism that can be used to move a plurality of radially mounted cranks through uniform and simultaneous angles of motion. Each arm 120 is provided with a crank arm 130 attached via a connecting link 132 at its outer end to a rotatable ring 134 held freely between guides 136. As ring 134 is rotated, it uniformly moves all such typical link and crank assemblies through approximately 90° of angle as shown by the dotted views shown in FIG. 9. A 90° angle will, of course, provide the desired motion for each vane to go from full-open to full-closed position.

In some cases, it will be found desirable to avoid imparting a rotary torque to the vessel caused by moving all vanes in the same direction. In such a case, it will be desirable to cause vane motion of alternate vanes in opposing directions. This kind of linkage (not shown) can also be simply provided by using upper and lower rings linked to move in opposing directions and connected to alternate vanes. Such motion will enable the vanes to interact as shown graphically in FIG. 9, thus avoiding the imparting of a rotary velocity vector to the water and similarly avoid imparting a reaction torque to the vessel.

The location of the damping mechanism along the vertical axis of the well will be determined by consideration of whether the damper should be designed to be water tight and thus enable the well to be pumped empty if desired for either maintenance of the well, or to reduce the ballast of the vessel for entering shallow harbors.

It has been seen from the preceding discussion that a general method and system, as well as specific arrangement for semi-submersible spheres and the like such as for oil drill rigs, cargo vessels etc., has been described whereby desired metacentric heights, deck clearances and the like are given. The heave compensating well is shown designed to provide not only desired long heave periods, but also large load lifting capacity in the vessel so that its vertical movement is minimized when heavy loads such as several thousand feet of drilling string or riser pipe are lifted.

The heave compensating well can be provided with either fixed or variable damping means to further gain control of vessel motion in the unpredictable combinations of wave, wind and current actions that occur in hostile marine environments.

The orifice at the lower end of the compensating well as provided in the present invention imposes only forces on the internal well which are parallel to the vertical axis of the vessel and thus, specifically and only in the direction of heave. This is contrary to the conventional form of "bilge keels" or "pontoons" which act on the free water surrounding the vessel. Thus, an advantage of this invention is that it cannot inadvertantly impose roll moments on the vessel due to unbalanced or non-vertical water velocities since the only water imparting damping force is the water flowing in the axial cylindric portion of the heave compensating well.

Another advantage of this invention is that the volume of water is known and has a determined enclosure, level and velocity. As a result these damping forces can be predicted and carefully controlled by controlling the opening area of a damping orifice.

Various modifications and changes have been described in the structure and operation of the present invention. Others will be obvious to those skilled in this art. In addition, various uses and employment of spheres tuned in accordance with this invention will be readily apparent. Therefore, it is intended that the present disclosure be viewed as illustrative only of the structure, function, use and benefit obtained, and not as limiting in any manner of the present invention.

What is claimed:

1. A vessel comprising a hull containing structural means, ballasting members, compartments, appurtenances, power means and the like having a generally spherical outer surface adapted to be partially submerged in an upright position along a vertical diametric axis in a body of water undergoing continuous wave action, the mean water line of said wave action defining a water plane intercept in a horizontal cross section of the hull, said hull having a center of gravity below the geometric center and at least one elongated well within the interior of the hull forming an internal well extending symmetrically about said diametric vertical axis, an opening at the top of said well communicating with the atmosphere and an opening at the bottom of said well communicating with said water to permit free flow of water in said well, said well being sufficiently enlarged in the horizontal cross section substantially along the mean water line so that in combination with the surface of the hull the water plane intercept is reduced such that the period of the vertical oscillation of said vessel is greater than the period of vertical oscillation of any waves reasonably expected to be encountered at any level of submergence.

2. The vessel according to claim 1 in which some of said compartments are in the form of cylinders concentric with the diametric axis of said body thereby defining a plurality of annular spaces surrounding said well.

3. The vessel according to claim 2 including partitions arranged to divide said spaces radially, whereby each of said compartments is shaped as a fraction of annulus.

4. A buoyant body comprising a hull containing structural means, ballasting members, compartments, appurtenances, power means and the like having a generally spherical outer surface adapted to be partially submerged in an upright position along a vertical diametric axis in a body of water undergoing wave action, the mean water line of said wave action defining a water plane intercept in a horizontal cross section of the hull, the weight of said body and that of its contents being selected in accordance with the following relation to obtain a body having a natural period of vertical oscillation according to the following formula:

$$Th = 2\pi \sqrt{W/g\,K_2},$$

where $T_h$ equals the natural period of vertical oscillation (heave);

W equals the total displacement of the body;

g equals the gravitational constant; and $K_2$ equals the change in buoyancy per foot of change in water line, said hull having a center of gravity below the geometric center and at least one elongated well within the interior of the hull extending along the vertical diametric axis of said hull, said well being open at both ends and communicating with the water and atmosphere, said well being sufficiently enlarged in the horizontal cross section substantially along the mean water line to significantly reduce the water plane intercept of the hull at any level of submergence so that the period of its vertical oscillation is increased to a desired value greater than the period of natural vertical oscillation.

5. A buoyant body comprising a hull containing structural means, ballasting members, compartments, appurtenances, power means and the like adapted to be partially submerged in a body of water undergoing constant wave action, the mean water line of said wave action defining a water plane intercept in a horizontal cross section of the hull, the outer surface of said hull being formed in the general shape of a spherical surface, said ballasting members structural members, and appurtenances or the like being so distributed so that the center of gravity is below the geometric center as to provide a righting moment making the body float with a predetermined portion up in an upright position along a vertical diametric axis, said hull having an elongated well extending symmetrically along said vertical diametric axis open at both ends to atmosphere and the flow of water therein and of such dimension as to receive therein a column of water the height of which is responsive to the pressure of said body of water at the lower opening of such well, said well being sufficiently enlarged in the horizontal cross section at least above the mean water line integrating with that of the outer surface of said hull to reduce the intercept plane of said hull to make the period of its vertical oscillation greater than the period of vertical oscillation of any waves of significant height reasonably expected to be encountered by the body.

6. The buoyant body according to claim 5 wherein said well has an upper portion in a funnel like shape, tapering outwardly to enlarge the well at least above the mean water line.

7. The buoyant body according to claim 5 wherein said well comprises a lower cylindrical portion communicating with the water, a central conical portion of greater radial extent, an intermediate cylindrical portion and an upper cylindrical portion opening from the top of said sphere.

8. The buoyant body according to claim 5 including a tubular member extending from the lower end of said well for communication with water at a level below said hull.

9. The buoyant body according to claim 8 including means for adjustably positioning said tube at varying depths.

10. The vessel according to claim 1 including means for operationally restricting the flow of said water into said well.

11. The buoyant body according to claim 4 including means for functionally restricting the flow of said water through said open lower end.

* * * * *